US007552612B2

(12) United States Patent
Heinicke

(10) Patent No.: US 7,552,612 B2
(45) Date of Patent: Jun. 30, 2009

(54) SYSTEMS FOR MAKING CAN ENDS

(75) Inventor: Paul R. Heinicke, Canton, OH (US)

(73) Assignee: Crown Packaging Technology, Inc., Alsip, IL (US)

( * ) Notice: Subject to any disclaimer, the term of this patent is extended or adjusted under 35 U.S.C. 154(b) by 253 days.

(21) Appl. No.: 11/458,907

(22) Filed: Jul. 20, 2006

(65) Prior Publication Data

US 2008/0041855 A1 Feb. 21, 2008

(51) Int. Cl.
*B21D 22/00* (2006.01)

(52) U.S. Cl. ..... 72/348; 72/415; 72/475; 413/56

(58) Field of Classification Search ..... 72/347, 72/348, 379.4, 414, 415, 474, 475; 413/1, 413/12, 15, 16, 17, 56, 62, 67, 8
See application file for complete search history.

(56) References Cited

U.S. PATENT DOCUMENTS

| | | | | |
|---|---|---|---|---|
| 3,499,314 | A | 3/1970 | Roberts et al. | |
| 4,495,797 | A | 1/1985 | Cassell, Jr. et al. | |
| 4,615,205 | A * | 10/1986 | Ragland, Jr. | 72/347 |
| 5,046,637 | A * | 9/1991 | Kysh | 220/610 |
| 5,214,953 | A | 6/1993 | Nish et al. | |
| 5,381,683 | A * | 1/1995 | Cowling | 72/329 |
| 5,685,189 | A * | 11/1997 | Nguyen et al. | 72/348 |
| 5,861,554 | A | 1/1999 | Dimmick, Sr. et al. | |
| 6,014,891 | A | 1/2000 | Kirks | |
| 6,098,829 | A * | 8/2000 | McHenry et al. | 220/62.12 |
| 6,240,769 | B1 | 6/2001 | Heuft | |
| 6,443,004 | B1 | 9/2002 | Heuft et al. | |
| 6,494,083 | B1 | 12/2002 | Heuft | |
| 6,837,093 | B2 * | 1/2005 | Yamasaki et al. | 72/379.4 |
| 7,066,702 | B2 * | 6/2006 | Turner et al. | 413/56 |
| 7,124,613 | B1 * | 10/2006 | McClung | 72/348 |

* cited by examiner

*Primary Examiner*—Edward Tolan
(74) *Attorney, Agent, or Firm*—Knoble, Yoshida & Dunleavy, LLC

(57) ABSTRACT

A method of making an easy open end for a container includes steps of providing a can end blank having an end panel and forming the can end blank in a series of forming operations that are performed with specialized and unique tooling. The can end is preferably shaped during the forming operations so that a major portion of the end panel is curved. Specifically, the curvature is preferably such that a top surface of the major portion is generally concave and a bottom surface of the major portion is generally convex. The end panel is also preferably shaped and constructed so that the curved major portion will invert in shape upon the application of a sufficient predetermined pressure differential between the top and bottom surfaces. A method of testing a fill level of a sealed container is performed in reliance on this "cricketing" or "oil canning" effect.

12 Claims, 5 Drawing Sheets

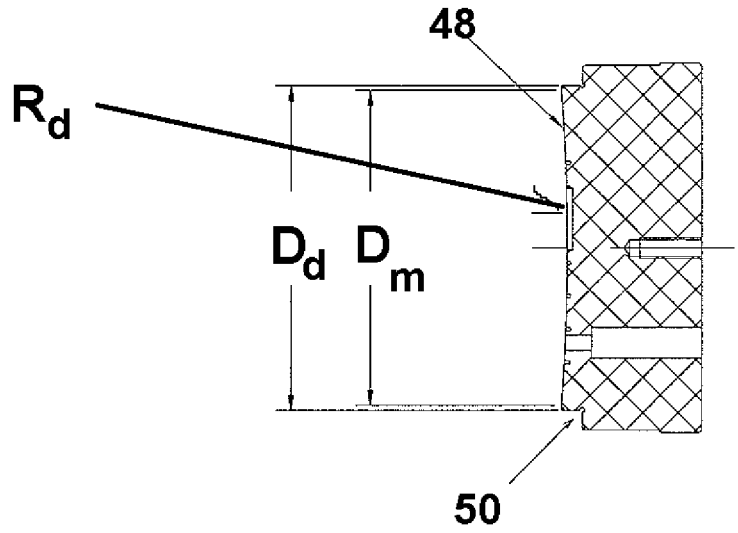
FIG. 6
FIG. 7
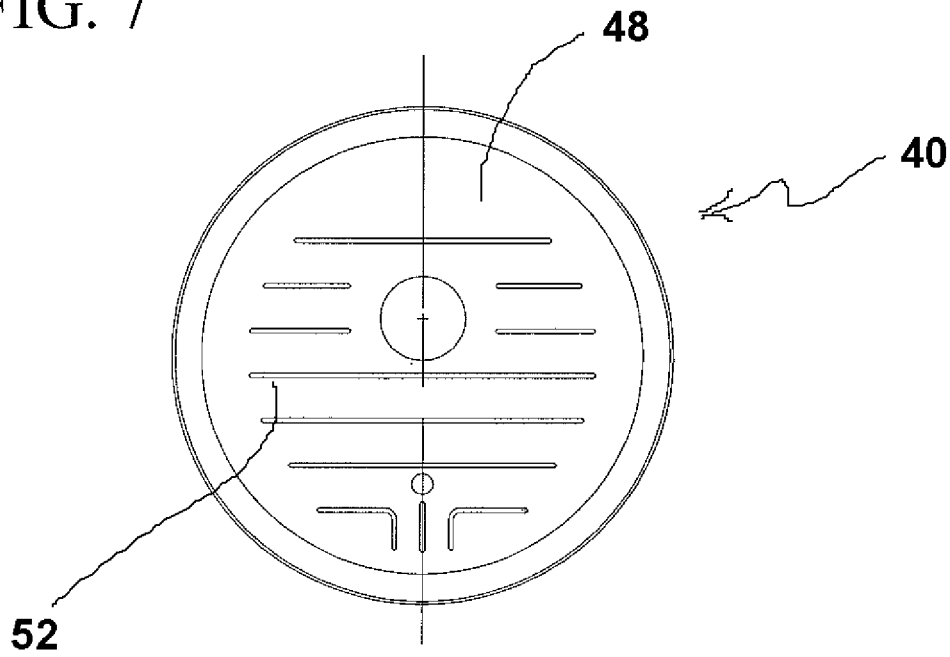

SYSTEMS FOR MAKING CAN ENDS

BACKGROUND OF THE INVENTION

1. Field of the Invention

This invention relates generally to containers, and particularly to containers such as metal cans and the metal can ends that are designed to be fastened and sealed to such containers.

2. Description of the Related Technology

Containers such as metal cans are typically filled at a packaging facility and then sealed by applying a metallic can end that is usually fastened to the can using the well-known double seaming process. The term "easy open end" is used generally for that class of ends for containers that are provided with a built-in mechanism for permitting the consumer to open the container at the end for access to the ingredients within the container, without requiring the use of a can opener or other external tool. One conventional easy open end employs a pull tab having a pointed nose, the pull tab being riveted to the panel of the end so that the nose rests adjacent a weakened area along the periphery of the end panel. To open, the pull tab is rotated in a vertical plane about the rivet, causing the nose to fracture the weakened area. Further pulling of the tab away from the end panel then causes the remainder of the weakened portion of the end panel along the score line to rupture, thereby permitting the end to be opened and the contents of the container to be accessed.

One type of easy-open end that is in wide use is the so called "full-open" end, in which a peripheral score, generally circular in configuration, is formed in the end panel at or adjacent to the periphery thereof to permit its complete removal. Full-open type cans are to be distinguished from those self opening cans which have a comparatively small removable section which, when opened, provide a comparatively small hole for dispensing the product. The latter type of can end is more appropriate for packaging soda, beer, or other liquids. Full-open type cans, on the other hand, are suitable for packaging solid products such as candy, nuts, meats, or ground coffee.

The integrity of metallic can ends must periodically be checked as a matter of quality control during the packaging process. There are a number of known systems and techniques available for such testing. One example is the Borden tester, the basic configuration of which is generally disclosed in U.S. Pat. No. 3,499,314 to Roberts et al. In that device, the can end is positioned within a testing fixture and a pressure differential is induced between the two sides of the can end. A transducer detects any seepage of gas that occurs through a defective can end and a sorting apparatus disposes of the leaky, defective can ends.

In addition, the fill level of product within the cans must periodically be checked at the packaging facility. There are also a number of known systems and techniques available for checking the fill level of sealed containers. For example, the size of the headspace within the container may be detected by placing the container within a pressurized or depressurized chamber and monitoring the flexure of the end panel of the can end. In other systems, vibration or sound may be applied to the sealed container and the response of the container or of the end panel may be measured. In such systems, it generally can be determined whether the lower portion of the end panel is in contact with the product.

While existing testing technology has been satisfactory in some respects, a need continually exists for improved packaging technology and improved systems and processes for testing can ends and monitoring the fill level of containers.

SUMMARY OF THE INVENTION

Accordingly, it is an object of the invention to provide an improved can end that optimizes the ability of a packaging facility to monitor the integrity of the can ends and to monitor the fill level of containers.

It is further an object of the invention to provide a method of making such a can end.

It is yet further an object of the invention to provide a tooling assembly for producing such can ends.

It is yet further an object of the invention to provide an improved method for testing can ends, and for monitoring the fill level of containers.

In order to achieve the above and other objects of the invention a tooling assembly for forming an end panel of an easy open can end includes a first forming tool for forming a top surface of a easy open can end, the first forming tool having a first working surface that includes a curved generally convex major portion that extends over at least about 75% of the first working surface; and a second forming tool that is constructed and arranged to work together with the first forming tool to form the end panel, the second forming tool having a second working surface that includes a curved generally concave major portion that extends over at least about 75% of the second working surface; and a press assembly for driving at least one of the first and second forming tools.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

FIG. 6 is a cross-sectional view of another component of the tooling assembly that is shown in FIG. 3;

FIG. 7 is a plan view of the component that is depicted in FIG. 6;

DETAILED DESCRIPTION OF THE PREFERRED EMBODIMENT(S)

Figure 1:
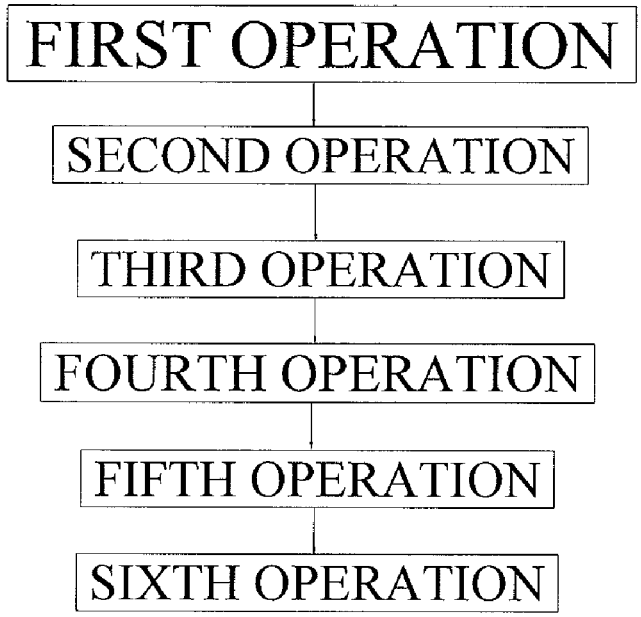
FIG. 1 is a diagrammatical depiction of a method of making a can end according to a preferred embodiment of the invention.
Figure 2:
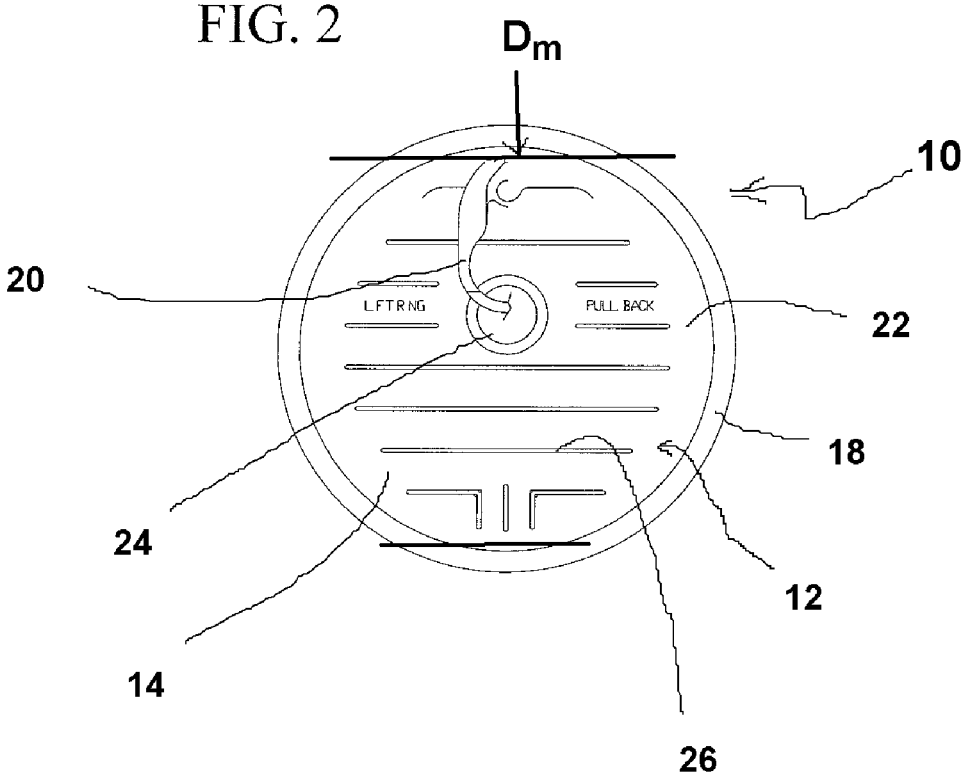
FIG. 2 is a top plan view of a can end that is constructed according to a preferred embodiment of the invention.

Referring now to the drawings, wherein like reference numerals designate corresponding structure throughout the views, and referring in particular to FIG. 1, a process of making an easy open can end 10 according to the preferred embodiment of the invention is preferably performed in a series of six forming operations. As FIG. 2 shows, the completed easy open can end 10 includes an end panel 12 that is preferably fabricated from a metallic material and has a top surface 14 and a bottom surface 16. Bottom surface 16 is best shown in FIG. 8(*a*).

Figure 9:
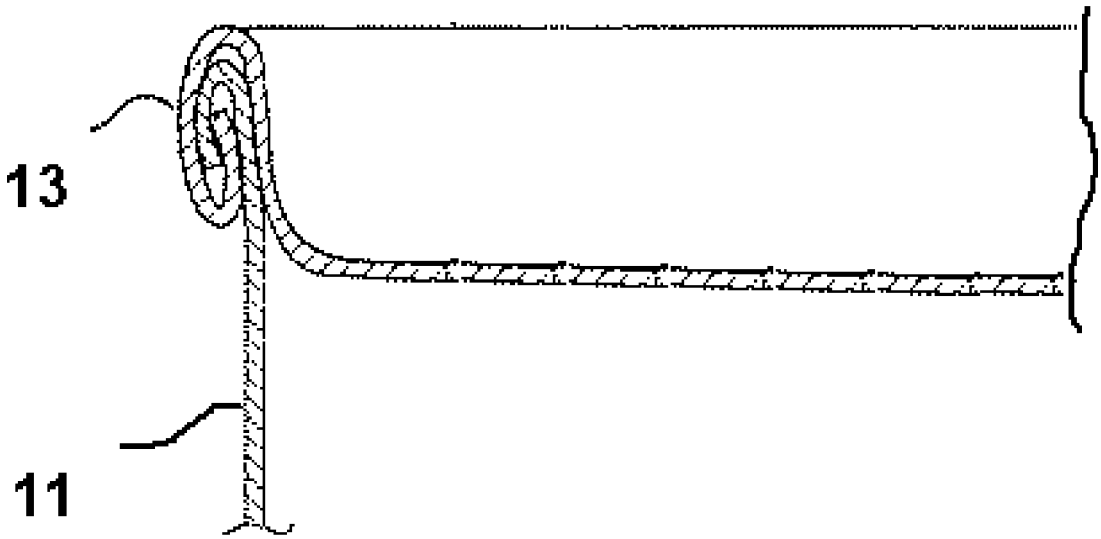
FIG. 9 is a fragmentary cross sectional depiction of a container assembly according to the invention.

The easy open can end that is depicted in FIG. 2 is a full open type, meaning that a score line is circumscribed about an outer periphery of the top surface 14 close to an end curl 18. The end curl 18 is provided for facilitating fastening of the easy open can end 10 to a container 11 as shown in FIG. 9 using a conventional double seaming process in which the end curl 18 is joined to the container 11 with a double seam 13. A pull tab 20 is fastened to the top surface 14 of the end panel 12 by a rivet in conventional fashion. By pulling upwardly on the pull tab 20 in a first direction, a consumer will force a nose portion of the pull tab 20 downwardly into the end panel 12 adjacent to the score line. This will rupture of the end panel 12 at the score line, which will permit the consumer to pull the pull tab 20 in a second direction in order to progressively separate the removable portion of the end panel from the rest of the easy open can end 10.

As may best be seen in FIGS. 8(*a*) through 8(*d*), a major portion 22 of the end panel 12 is preferably curved so that the top surface 14 is shaped to be generally concave and the bottom surface 16 is shaped to be generally convex. The major portion 22 of the end panel 12 preferably occupies at least 75% of a total surface area of the end panel, and more preferably occupies at least 85% of a total surface area of the end panel. Most preferably, the major portion 22 of the end panel 12 preferably occupies at least 95% of a total surface area of the end panel. As FIG. 2 shows, the end panel 12 may have one or more depressions 24 defined therein that are superimposed upon the curvature of the major portion 22 of the end panel 12.

Preferably, the major portion 22 of the end panel 12 is curved so as to define a substantially constant radius of curvature $R_1$ within at least one cross-sectional plane taken therethrough, such as the cross-sectional plane that is depicted in FIGS. 8(*a*) through 8(*d*). In the preferred embodiment, the major portion 22 of the end panel 12 is substantially spherically curved. The substantially constant radius of curvature $R_1$ is preferably within a range of about 10 inches to about 75 inches, more preferably within a range of about 15 inches to about 50 inches, and most preferably within a range of about 20 inches to about 40 inches.

The major portion 22 of the end panel 12 is preferably although not necessarily substantially circular in shape when viewed in top plan, as is shown in FIG. 2. Preferably, a ratio of the substantially constant radius of curvature $R_1$ to a diameter $D_m$ of the major portion 22 is within a range of about 0.05 to about 0.4, more preferably within range of about 0.09 to about 0.25 and most preferably within range of about 0.11 to about 0.20.

According to one particularly advantageous aspect of the invention, the major portion 22 of the end panel 12 is constructed and arranged to facilitate a shape change of the curved major portion 22 when a predetermined pressure differential as applied between the top surface 14 and the bottom surface 16. More specifically, the curved major portion 22 is initially formed during manufacturing as shown in FIG. 8(*a*) in a manner that will be described in greater detail below to have an initial radius of curvature $R_1$. The initial radius of curvature $R_1$ in the most preferred embodiment for a major portion 22 that is approximately 3.6 inches in diameter $D_m$ is approximately 28 inches. However, as a result of a memory effect within the metallic material from which the end panel 12 is fabricated, the curved major portion 22 of the can ends 10 will revert to a predetermined extent to a flatter shape when in a relaxed state such as when not being acted upon by any pressure or temperature differential. In this relaxed state, which is shown diagrammatically in FIG. 8(*b*), the substantially constant radius of curvature will increase to a value $R_2$ that is greater than the initial substantially constant radius of curvature $R_1$. This transition between the as-formed and relaxed states is also preferably and advantageously accompanied by an audible sound, produced by what is commonly known as an "oil canning" or "cricketing" effect.

In a packaging facility, a container 11 such as a metallic can will be filled with material such as food, and then the easy open end 10 will be fastened and sealed to the container 11 using the conventional double seaming process. Prior to securing the easy open end 10 to a container the packaging facility may desire to test the integrity of the easy open end 10. This can be done by using a pressure based tester such as the Borden tester discussed above. In conducting such testing, the major portion 22 of the easy open end 10 may be initially subjected to a pressure that causes the major portion 22 to revert to its as-formed shape, wherein the substantially constant radius of curvature is the initial substantially constant radius of curvature $R_1$. The testing apparatus may then be configured so that in the event of a predetermined magnitude of leakage of the pressurized testing gas through the easy open end 10 the pressure differential between the top surface 14 and the bottom surface 16 will be equalized to an extent wherein the major portion 22 will return to the relaxed state and the radius of curvature $R_2$. In doing so, it will generate a detectable oil canning or cricketing sound that can be detected by an operator and/or by the testing system.

After the easy open end 10 is secured to a container 11, a packaging facility will typically desire the ability to check the fill level of the container 11 as a matter of process and/or quality control. Usually, comestible items such as food are packaged in a partial vacuum or underpressure. The resulting pressure differential between the top surface 14 and the bottom surface 16 according to the preferred process will cause the major portion 22 to revert to its as-formed shape and the initial substantially constant radius of curvature $R_1$. If the sealed container is heated, such as during a retort process, the major portion 22 may return to the relaxed state temporarily as the pressure differential between the top surface 14 and the bottom surface 16 is temporarily used by the expansion of the contents of the container 11. However, when the container 11 is cooled, the major portion 22 will return to the as-formed shape and the initial substantially constant rate use of curvature $R_1$.

According to another advantageous feature of the invention, it is possible to detect the fill level within the container 11 by either heating the container 11 or subjecting the outside of the container 11 to an underpressure. The empty space within the container 11 between the fill level and the underside 16 of the can end 10 is known as the head space. The pressure differential between the top surface 14 and the bottom surface 16 of the end panel 12 for any given underpressure that is applied to the exterior of the container 11 or any temperature to which the container is heated will depend to a predictable extent upon the amount of head space that is present within the container 11 and accordingly on the fill level of the container 11. The major portion 22 of the can ends 10 is designed to revert to the relaxed shape and the second radius of curvature $R_2$ at a predetermined, known pressure differential between the top surface 14 and the bottom surface 16. Since this is a known engineered characteristic of the can ends 10, the fill level of the containers 11 may be determined using a simple algorithm that will be apparent to those skilled in the art based upon the amount of underpressure that is applied to the exterior of the container or the temperature to which the container 11 has been heated.

In a first forming operation as is shown diagrammatically in FIG. 1, a conventional planar can end blank 10 is pressed in a punch and die assembly in conventional fashion to form a side curl 18 at the peripheral edge of the end 10. In the preferred embodiment, the forming of the can end blank 10 is performed in six sequential forming operations. In the first operation, the bubble rivet is formed. In the second operation, the bubble rivet is reduced to a button of the final desired size of the rivet. In the third operation, the end panel is scored as may be required. In the fourth operation, a tooling assembly 30 is used to form the major portion 22 and its characteristic curved surface. This will be described in greater detail below. In the fifth operation, tab placement occurs. In the sixth and final operation, tab detection takes place.

Figure 3:
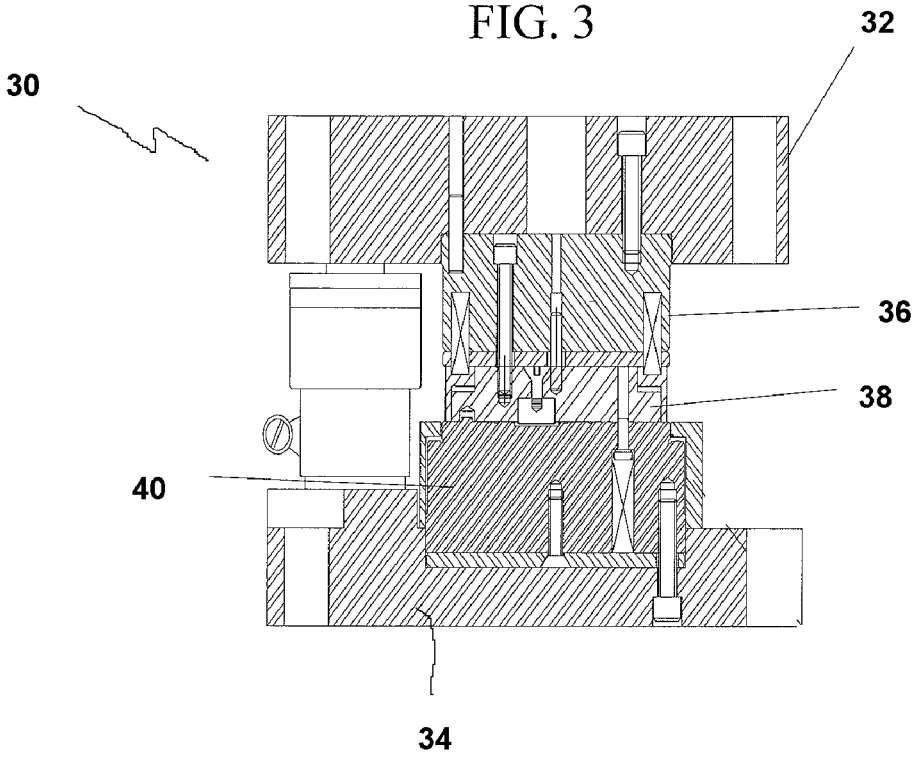
FIG. 3 is a cross-sectional view of a tooling assembly that is constructed according to a preferred embodiment of the invention.

Referring now to FIG. 3, tooling assembly 30 preferably includes an upper die shoe 32, a lower die shoe 34 and a punch holder 36 for holding a bead punch 38 supported by the upper die shoe 32. The lower die shoe 34 supports a bead die 40, which will be described in greater detail below.

Figure 4:
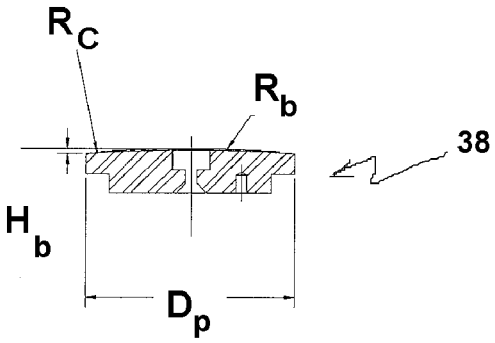
FIG. 4 is a cross-sectional view of one component of the tooling assembly that is shown in FIG. 3.
Figure 5:
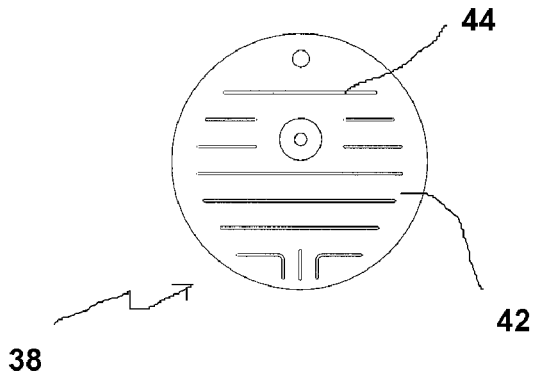
FIG. 5 is a plan view of the component that is depicted in FIG. 4.
Figure 8A:
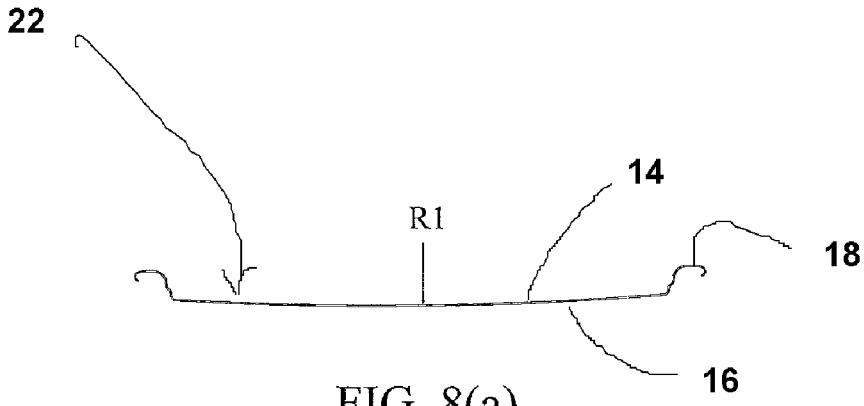
FIGS. 8(*a*) through 8(*d*) are a diagrammatical depiction of a characteristic of a can end that is constructed according to a preferred embodiment of the invention.
Figure 8B:
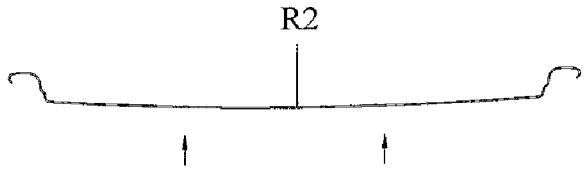
Figure 8C:
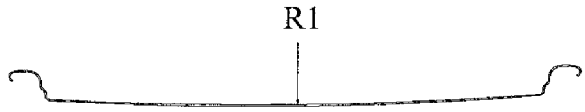
Figure 8D:
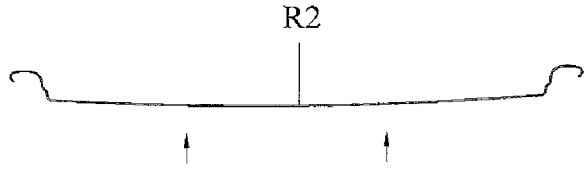

FIG. 4 depicts the bead punch 38, which is the preferred embodiment of a first forming tool for forming the top surface 14 of an easy open can end 10 according to the invention. The bead punch 38 preferably has a first working surface that includes a curved generally convex major portion 42 that preferably extends over at least about 75% of the first working surface. More preferably, the curved generally convex major portion 42 preferably extends over at least about 85% and even more preferably at least 95% of the first working surface. As is best shown in FIG. 5, the working surface further preferably defines a plurality of bead projections 44 that form stiffening beads in the major portion 22 of the end panel 12. The stiffening beads may improve the opening characteristics of the easy open end 10, and may also be used to regulate the conditions, such as the pressure differential between the top surface 14 and bottom surface 16 under which the major portion 22 will make the transition between the as-formed shape and the relaxed shape.

FIGS. 6 and 7 depict the bead die 40, which is the preferred embodiment of a second forming tool that is constructed and arranged to work together with said first forming tool to form the end panel 12. The bead die 40 is provided with a second working surface that includes a curved generally concave major portion 48 that preferably extends over at least about 75% of the second working surface. More preferably, the major portion 48 extends over at least about 85% of the second working surface and most preferably the major portion 48 extends over at least about 95% of the second working surface.

The curved generally concave major portion 48 of the bead die 40 is generally complementary in shape to the top surface 14 of the end panel 12 described above, while the curved generally convex major portion 42 of the bead punch 38 is generally complementary in shape to the bottom surface 16 of the end panel 12. Accordingly, the curved generally concave major portion 48 has a diameter of $D_m$ and is preferably curved at a substantially constant radius of curvature $R_d$ that is substantially the same as the as-formed initial radius of curvature $R_1$ of the major portion 22 of the end panel 12. Likewise the curved generally convex major portion 42 is preferably curved at a substantially constant radius of curvature $R_c$ that is substantially the same as the as-formed initial radius of curvature $R_1$ of the major portion 22 of the end panel 12. In practice, there will be a slight variation between the substantially constant radius of curvature $R_c$ and the substantially constant radius of curvature $R_d$ as a result of the thickness of the end panel 12, with the radius of curvature $R_d$ being slightly greater than the radius of curvature $R_c$. The magnitude of the difference, however, is quite small in comparison to the initial radius of curvature $R_1$. The bead projections 44 are preferably curved at their uppermost portions at a radius $R_b$ that is slightly greater than the radius $R_c$. The bead punch 38 has a major portion diameter $D_p$, and the bead projections have a height $H_b$ measured from the base surface of the major portion 42. The bead die 40 has an overall working diameter $D_d$.

The substantially constant radius of curvature $R_c$ and a substantially constant radius of curvature $R_d$ are both preferably within a range of about 10 inches to about 75 inches, more preferably within a range of about 15 inches to about 50 inches and most preferably within a range of about 20 inches to about 40 inches. The convex major portion 42 of the bead punch 38 and the concave major portion 48 of the bead die 40 are both preferably spherically curved.

The ratio of the substantially constant radius of curvature $R_c$ of the major portion 42 of the bead punch 38 to the diameter $D_p$ of the major portion 42 is preferably within a range of about 0.05 to about 0.4, more preferably within a range of about 0.09 to about 0.25 and most preferably within a range of about 0.01 to about 0.20. Likewise, the ratio of the substantially constant radius of curvature $R_d$ of the major portion 48 of the bead die 40 to the diameter $D_m$ of the major portion 48 is preferably within a range of about 0.05 to about 0.4, more preferably within a range of about 0.09 to about 0.25 and most preferably within a range of about 0.01 to about 0.20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A tooling assembly for forming an end panel of an easy open can end, comprising:

a first forming tool for forming a top surface of a easy open can end, said first forming tool having a first working surface that includes a curved generally convex major portion that extends over at least about 75% of said first working surface; and a second forming tool that is constructed and arranged to work together with said first forming tool to form said end panel, said second forming tool having a second working surface that includes a curved generally concave major portion that extends over at least about 75% of said second working surface; and a press assembly for driving at least one of said first and second forming tools;

wherein said curved generally concave major portion of said second forming tool is curved at a substantially constant radius of curvature within at least one cross-sectional plane taken therethrough;

wherein said major portion of said second forming tool is substantially circular in shape when veiwed in plan, and wherein a ratio of said substantially constant radius of curvature to a diameter of said major portion is within a range of about 0.05 to about 0.4.

2. A tooling assembly according to claim 1, wherein said curved generally convex major portion of said first forming tool comprises at least 85% of said first working surface.

3. A tooling assembly according to claim 2, wherein said curved generally convex major portion of said first forming tool comprises at least 95% of said first working surface.

4. A tooling assembly according to claim 1, wherein said curved generally concave major portion of said second forming tool comprises at least 85% of said second working surface.

5. A tooling assembly according to claim 4, wherein said curved generally concave major portion of said second forming tool comprises at least 95% of said second working surface.

6. A tooling assembly according to claim 1, wherein said first and second forming tools further have structure thereon for forming at least one depression in the end panel, said depression being superimposed upon the curvature of the major portion of the end panel.

7. A tooling assembly according to claim 1, wherein said curved generally concave major portion of said second forming tool is spherically curved.

8. A tooling assembly according to claim 1, wherein said substantially constant radius of curvature is within a range of about 10 inches to about 75 inches.

9. A tooling assembly according to claim 8, wherein said substantially constant radius of curvature is within a range of about 15 inches to about 50 inches.

10. A tooling assembly according to claim 9, wherein said substantially constant radius of curvature is within a range of about 20 inches to about 40 inches.

11. A tooling assembly according to claim 1, wherein said ratio of said substantially constant radius of curvature to a diameter of said major portion is within a range of about 0.09 to about 0.25.

12. A tooling assembly according to claim 11, wherein said ratio of said substantially constant radius of curvature to a diameter of said major portion is within a range of about 0.11 to about 0.20.

* * * * *